US006403908B2

(12) United States Patent
Stardust et al.

(10) Patent No.: US 6,403,908 B2
(45) Date of Patent: Jun. 11, 2002

(54) AUTOMATED METHOD AND APPARATUS FOR PLAYING CARD SEQUENCING, WITH OPTIONAL DEFECT DETECTION

(76) Inventors: Bob Stardust; Richard L. Maggio, both of 5322 E. Pinchot, Phoenix, AZ (US) 85018

( * ) Notice: Subject to any disclaimer, the term of this patent is extended or adjusted under 35 U.S.C. 154(b) by 0 days.

(21) Appl. No.: 09/745,162

(22) Filed: Dec. 22, 2000

Related U.S. Application Data

(63) Continuation-in-part of application No. 09/255,615, filed on Feb. 19, 1999, now abandoned.

(51) Int. Cl.[7] ..... B07C 5/34; A63F 1/14

(52) U.S. Cl. ..... 209/587; 209/547; 209/939; 273/149 P; 271/176

(58) Field of Search ..... 209/939, 547, 209/587, 701, 576, 577; 382/100; 273/149 R, 149 P; 463/22; 271/176

(56) References Cited

U.S. PATENT DOCUMENTS

| | | | | | |
|---|---|---|---|---|---|
| 3,114,553 | A | * | 12/1963 | Stone, Sr. | 273/149 |
| 3,312,473 | A | * | 4/1967 | Friedman et al. | 273/149 |
| 3,452,509 | A | * | 7/1969 | Hauer | 273/149 |
| 4,388,994 | A | * | 6/1983 | Suda et al. | 209/564 |
| 4,415,566 | A | | 11/1983 | Wetzel et al. | |
| 4,667,959 | A | * | 5/1987 | Pfieffer et al. | 273/149 |
| 4,822,050 | A | * | 4/1989 | Normand et al. | 273/149 |
| 4,921,109 | A | | 5/1990 | Hasuo | |
| 5,009,332 | A | * | 4/1991 | Sannel et al. | 209/652 |
| 5,119,954 | A | * | 6/1992 | Svyatsky et al. | 209/584 |
| 5,121,921 | A | * | 6/1992 | Friedman | 273/149 |
| 5,277,321 | A | * | 1/1994 | Nagasawa et al. | 209/583 |
| 5,363,971 | A | * | 11/1994 | Weeks et al. | 209/584 |
| 5,431,399 | A | | 7/1995 | Kelley | |
| 5,558,232 | A | | 9/1996 | Stevens et al. | |
| 5,669,816 | A | | 9/1997 | Garczynski | |
| 5,722,893 | A | | 3/1998 | Hill | |
| 5,989,122 | A | * | 11/1999 | Roblejo | 463/22 |
| 6,105,861 | A | * | 8/2000 | Kuit | 235/375 |
| 6,250,632 | B1 | * | 6/2001 | Albrecht | 273/149 |
| 6,267,248 | B1 | * | 7/2001 | Johnson et al. | 209/547 |

FOREIGN PATENT DOCUMENTS

| | | | | |
|---|---|---|---|---|
| DE | 3815571 A1 | * | 12/1988 | A63F/1/12 |
| JP | 2000255877 A | * | 9/2000 | |

* cited by examiner

*Primary Examiner*—Donald P. Walsh
*Assistant Examiner*—Daniel Schlak
(74) *Attorney, Agent, or Firm*—LaValle D. Ptak

(57) ABSTRACT

An automated method and apparatus for sequencing and/or inspecting decks of playing cards is presented. The method and apparatus utilizes pattern recognition technology or other image comparison technology to compare one or more images of a card with memory containing known good images of a complete deck of playing cards to identify each card as it passes through the apparatus. Once the card is identified, it is temporarily stored in a location corresponding to or identified according to its position in a properly sequenced deck of playing cards. Once a full set of cards has been stored, the cards are released in proper sequence to a completed deck hopper. The method and apparatus also includes an operator interface capable of displaying a magnified version of potential defects or problem areas contained on a card which may then be viewed by the operator on a monitor or screen and either accepted or rejected via operator input. The present invention is also capable of providing an overall wear rating for each deck of playing cards.

8 Claims, 6 Drawing Sheets

AUTOMATED METHOD AND APPARATUS FOR PLAYING CARD SEQUENCING, WITH OPTIONAL DEFECT DETECTION

RELATED APPLICATION

This application is a continuation-in-part of application Ser. No. 09/255,615 filed on Feb. 19, 1999 now abandoned.

BACKGROUND

The present invention relates to an automated method and apparatus for sequencing and/or inspecting playing cards. More particularly, the present invention relates to an automated method and apparatus which will sequence a standard deck of playing cards and alternatively check the playing cards for possible detects. In addition to performing a computerized check for playing cards with possible defects, the present invention includes an operator interface that will display a magnified version of a potentially defective area of a card on a monitor for view by an operator, and query the operator as to whether to accept or reject the card in order to allow for further inspection.

The method and apparatus of the present invention for sequencing a used deck of playing cards outputs complete decks of playing cards, with all cards facing the same way in proper sequence. An optional method and apparatus of the present invention supplies the operator of the method and apparatus with an overall wear rating for each deck of playing cards.

Casinos offer various card games including, but not limited to, poker, baccarat and blackjack. Poker is played using one deck of playing cards, while blackjack and baccarat are typically played using multiple decks of playing cards that are shuffled together. In fact, in casinos, blackjack is often played using four decks of playing cards and baccarat is often played using eight decks of playing cards.

All of the decks of playing cards used, however, comprise standard fifty-two card decks, with each deck having four suits, and each suit having thirteen cards. New decks of playing cards arrive in standard sequence by suit and by rank within each suit. Each properly ordered suit is arranged within a new deck of playing cards in the following sequence: diamonds, clubs, hearts and spades. In addition, each suit contains thirteen cards in proper order starting with the king and descending in order down to the ace. Accordingly, in a brand new deck of properly ordered playing cards, the king of diamonds is always the top card in the deck and the ace of spades is always the bottom card in the deck. New decks of playing cards are typically provided in sets. Each set contains two properly sequenced decks of playing cards existing side by side, with each of the two decks having a different color back.

When brand new decks of playing cards are first received by a casino, each deck of cards must be certified as being good and acceptable for play before the deck can be used. In order to certify that deck of playing cards is good and acceptable for play, the casino must ascertain that: (1) there is one and only one of each type (i.e. by suit and rank) of playing card in the deck of playing cards, (2) all of the backs of the playing cards contained in the deck are of the same color, (3) there are no defective playing cards (i.e. torn or cracked cards, cards with dimples or fingernail marks, cards with missing print or cards with spots), and (4) there are no boxed cards (cards facing backwards, etc.) contained in the deck of playing cards.

When a deck of playing cards is put into play at a casino, the dealer spreads the deck out on the table in front of the players to verify, for the house and the players, that the entire deck of playing cards is there and that the deck is a good deck of cards that is acceptable for play. The deck must be in proper sequence when it is spread out for inspection so that it can be easily checked for play. If the deck is not in proper sequence, the decks are not used and a new set up, i.e. a new set of two decks of playing cards is brought into play.

Casinos use expensive, long lasting decks of playing cards, and continually reuse their decks of playing cards rather than throwing the cards away after their first use. "New" (i.e., for the most part, recycled) decks of playing cards are brought into a game fairly often since, for example, in poker any player at a table may ask for a new set up, i.e. a new set of two decks, to be brought in to replace the two existing decks at the table almost as often as he/she wants. In addition, a new set up comprising two new decks of playing cards is brought into a card game any time a bad playing card is found during the course of the game.

Casinos accumulate multiple decks of unsorted playing cards which have to be checked for defects and marks and then put back into their proper sequence, i.e., proper suit and rank order, before they can be reused. Before a used deck of playing cards can be reused, it must be checked for all of the conditions described above with respect to new decks of playing cards, as well as being checked for any accidental or intentional marks which may have inadvertently or deliberately been placed on the backs of the playing cards.

When activity is slow in a casino, casino employees, namely the dealers or floor persons, put the playing cards back into their proper sequence while looking the cards over for defects or aberrations. Problems arise, however, when the casinos become busy in that casino employees have less spare time to sequence and inspect the decks of used playing cards.

During these busy times, casinos typically will require dealers coming off their table rotations, who should be going on their breaks, to instead spend time sequencing the used decks of playing cards. Obviously, the dealers are not functioning at peak performance during these times when they should be taking their breaks but are instead sequencing playing cards. As a result, the employees attempt to sequence the used playing cards as quickly as possible, thereby increasing chances for mis-ordering cards and failing to identify cards having defects or aberrations.

Further, when casinos are very busy and employees do not have time to sequence the used decks of playing cards, the casinos run out of playing card set ups, i.e. sets of decks of properly sequenced playing cards. Accordingly, when a player asks for a new deck of cards to be brought into the game, dealers are instead instructed to simply reshuffle the deck of cards that is already in play. The failure to introduce a new deck of playing cards is not well accepted by the players.

In addition, casinos typically have difficulty in determining when a used deck of playing cards is too old and worn for further use. In fact, casinos typically do not have any objective measure for determining when a used deck of playing cards should be retired and no longer used.

Various methods and apparatus for optically identifying playing cards exist in the prior art. For example, U.S. Pat. No. 5,669,816 issued to Garczynski et al, discloses a blackjack scanner apparatus and method which includes a scanner for scanning at least a portion of a dealer's first standard playing card, memory for storing indicia representative of cards contained in a standard deck of playing cards, means for comparing and determining the identity of the first playing card based on comparison with indicia representing each of the playing cards contained in the standard deck of cards, means for the dealer to input the identity of the dealer's second playing card, means for reporting when the first and second playing cards comprise blackjack, and a dealer shoe which includes the reporting means. This method and apparatus utilizes optical lenses to project the character of a playing card onto an array chip and microprocessor and memory chips to compare the result of the projected playing card with a set of references which relate to each of the individual cards contained within a deck of playing cards. The object of the invention is to announce when a dealer has blackjack without even the dealer knowing the dealer's down card.

U.S. Pat. No. 5,722,893 to Hill et al. describes a shuffled card dispensing shoe with an optical sensor which scans indicia on the playing cards as the cards move along and out of the shoe and an automated card tracking system. The system includes (1) an elongated housing having a chute for manually removing cards one-by-one from the deck, (2) means for scanning indicia on each of the cards as they are moved one-by-one out of the housing, such as an infrared laser scanner for reading a bar code imprinted on the cards, an opto-sensor capable of scanning the card image to be used with a neural network that can recognize the images printed on the face of the cards, an infrared laser scanner with an optical character recognition reader, or a charged coupling device laser capable of capturing and recognizing the images printed on the-face of each card, and (3) means for coupling the scanner to a host computer for processing the signal to determine trends in the order of cards dispensed from the shoe relative to a card count system. The scanner includes a feed forward neural network which is trained using error-back propagation to recognize card rank within a deck of playing cards. The primary object of this invention is to track playing cards dispensed from the shoe in order to determine how many good cards versus bad cards have been dispensed from the shoe thereby allowing the identification of times when odds shift in favor of a card counting player.

Another method and apparatus for scanning and dispensing playing cards is disclosed in the U.S. Pat. No. 5,431,399 issued to Kelley. The Kelley patent reference discloses a method and apparatus for automatically dealing playing cards in a predetermined pattern wherein the apparatus includes an enclosure for holding a deck of cards where the base of the enclosure has one or more slots, means for scanning or reading the indicia or code on a playing card, a processor for processing the indicia or code and matching that information against a predetermined pattern and activating a card displacement means, and a card displacement means for removing a single card from the bottom of the deck through one of the slots in the base of the enclosure. The main object of this invention is to provide for the automatic distribution of playing cards in a random or predetermined order.

A general card sorting method and apparatus for all types of cards is disclosed in the U.S. Pat. No. 4,921,109 issued to Hasuo et al. The card sorting apparatus includes at least two card stackers, a sensor for reading indicia on the cards, a card rack for holding multiple cards, and a memory for storing information relating to the cards held by the card rack where the card rack is connected to at least one of the card stackers. During use, a predetermined number of cards is transferred to a card rack and are compared with another group of cards transferred to the card rack. Cards satisfying the comparison are fed into a card stacker and cards are sorted in advance between the card rack and card stacker. This general card sorting method and apparatus utilizes a card reader to read characters and symbols on the cards in order to select cards meeting specific criteria.

Many of the systems described above perform card identification in order to perform a mathematical calculation such as the existence of a blackjack hand (hand totaling 21) or whether the odds for a player counting cards has turned in that player's favor. However, none of the above card scanning and dispensing methods and apparatus perform automatic sequencing of a randomly arranged deck of cards.

The Stevens U.S. Pat. No. 5,558,232 is not directed to playing cards; but it does disclose an apparatus for sorting documents. In the apparatus of the Stevens patent, documents are supplied through an optical scanner which scans particular areas of interest in the documents and displays those areas on a cathode ray tube display. An operator viewing the display then manually activates a switch to send the selected document to a particular output bin. The number of output bins or options is determined by the various characteristics which require an operator decision. This system is a document sorter. It does not place the documents in any particular order. They are stacked in the output bins on top of one another in sequence in the order in which they are supplied through the scanner system.

The Peyton U.S. Pat. No. 4,415,566 is directed to a sophisticated sorting mechanism for sorting bottles, such as soft drink bottles, supplied to it, onto one of a limited number of pre-assigned outlet conveyors for each different bottle type supplied to the system. In order to determine the bottle type, the indicia or decoration printed on the bottle is optically scanned and compared with stored images corresponding to the different bottle types which are handled by the system. When a comparison verification is made, a delivery device deposits the bottle onto a conveyor for that bottle type. Consequently, the system sorts the bottles supplied to its input onto several different output conveyors. There is no rearranging of the order of the bottles into a sequence, however; they are simply deposited onto the conveyors in the same order in which they are supplied to the system. The device of the Peyton patent does disclose the utilization of stored memory indicia having pre-established characteristics for comparison with optically scanned images as the bottles pass through the system, in order to determine in which of the different output conveyors (or bins) the bottles are to be deposited.

In addition, with respect to the playing card identification methods and apparatus previously described, none of those prior art references include a method and apparatus wherein individual playing cards may be ordered in sequence and, optionally, evaluated for possible defects which would disqualify their use for a fair game involving playing cards, especially with respect to games of chance such as those played in casinos. In addition, in order to ensure a fair game in games of chance using playing cards, it is important to retire those decks of playing cards which have undergone an extensive amount of wear.

Accordingly, an efficient and effective method and apparatus for sequencing and, optionally, inspecting playing cards is needed which has the ability to output an acceptable deck of playing cards for use in games of chance, wherein all of the playing cards are facing the same way, in proper sequence, i.e., in proper suit and rank order.

SUMMARY OF THE INVENTION

It is a principal object of this invention to provide an automated method and apparatus for the efficient and effective sequencing of playing cards.

It is another object of this invention to provide an automated and interactive method and apparatus for detecting defects in playing cards and ejecting those cards in order to eliminate their use in a deck of playing cards which would produce inaccurate or unfair results in a game of chance.

It is still another object of this invention to provide an automated method and apparatus for sequencing a deck of playing cards such that the deck of playing cards is sorted and arranged by proper suit and rank order.

It is yet another object of this invention to provide an automated and interactive method and apparatus for inspecting playing cards which provides for operator interface in determining the acceptance or rejection of a given individual playing card.

Still another object of this invention is to provide an automated method and apparatus for sequencing playing cards which produces an overall wear rating for each deck of playing cards.

Yet another object of this invention is to provide an automated method and apparatus, which is operator interactive, for inspecting a standard deck of playing cards.

It is another object of this invention to provide an automated method and apparatus for sequencing playing cards having an increased efficiency due to the limited number of movements required by both the playing cards themselves and the apparatus in order to achieve sequencing of the playing cards with as little wear on the cards as possible.

It is still another object of this invention to provide an automated method and apparatus for sequencing and inspecting playing cards having increased efficiency and cost effectiveness due to the reduced number of physical and movable parts required for the method and apparatus.

It is also an object of this invention to provide an automated method and apparatus for inspecting playing cards which exhibits an increase in the accuracy of detecting playing cards having unacceptable defects by using pattern recognition technology to look for defects while also allowing for subjective input by providing an operator interface.

In accordance with a preferred embodiment of the invention, an automated apparatus is provided for sequencing a deck of playing cards. The sequencing apparatus includes an input hopper for holding a deck of playing cards. This hopper is designed to permit removal of the playing cards from it one at a time; and cards are fed one at a time to an imaging device, which images at least one side of a playing card. A control processor is responsive to an output signal from the imaging device for determining the position each card supplied past the imaging device should occupy in a properly sequenced deck of cards. The position information from the control processor is used to locate the cards in selected positions in a temporary storage device. Mechanism then is provided for removing the cards from the temporary storage device, one at a time, in the order of a properly sequenced deck of cards thereby delivering a properly sequenced deck of cards to a desired location.

The present invention also includes a method for sequencing a deck of playing cards comprising the steps of inputting at least one deck of playing cards into a housing; feeding a playing card from the deck of playing cards into an imaging means; comparing the image of the playing card with a plurality of stored images of playing cards included in the deck of playing cards to determine the identity the position the playing card occupies in a properly sequenced deck of cards; and removing the playing cards, one at a time, to form a properly sequenced deck of cards.

An alternative method of the present invention also utilizes the comparison of stored, known and acceptable images of playing cards to determine whether a card has any problem areas or defects.

DETAILED DESCRIPTION

Figure 1:
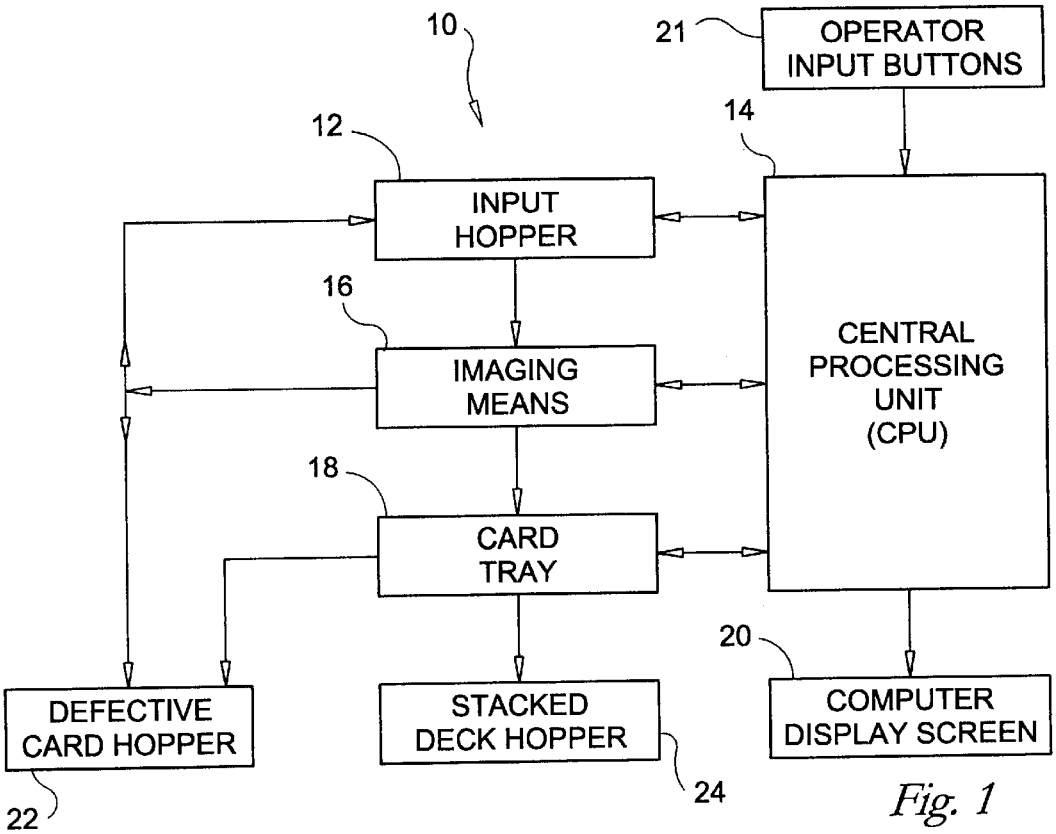
FIG. 1 is a schematic of the components of an automated apparatus of the present invention for sequencing and/or inspecting playing cards.

A schematic showing the components of the automated apparatus of one embodiment of the present invention for sequencing and/or inspecting playing cards is shown in FIG. 1. The automated apparatus 10 includes a card input hopper 12, a central processing unit 14, an imaging means 16, a card tray for holding playing cards 18, a computer display screen having operator input capabilities 20, an ejected card hopper 22 and a completed deck hopper 24.

The input hopper is capable of holding one or more decks of playing cards and includes means for dispensing individual playing cards one at a time. The input hopper 12 feeds. individual playing cards to the imaging means 16, which takes multiple images of the playing card. The imaging means 16 also includes means for diverting the imaged playing card to the card tray 18, the ejected card hopper 22, or as an optional feature, back to the input hopper 12 into which the playing cards are loaded. The imaging means may be a scanner, a digital camera, or any other device that is capable of producing an electronic image(s) of an object. Although digital cameras are able to provide images of an object much more quickly than scanners, scanners are able to provide much more accurate images of the object. The type of imaging means utilized within the method and apparatus of the present invention will depend on the type of result needed, i.e., whether accuracy can be sacrificed in order to produce faster results. Any number of digital cameras or scanners known in the art are contemplated for use within the method and apparatus of the present invention.

The card tray 18 of the present invention receives cards from the imaging means 16. The card tray 18 functions as a tray in which accepted playing cards are received into specific slots within the tray depending on the order and suit of the card (that is, the proper position of the card in a properly sequenced deck of cards). More specifically, each slot or opening contained in the card tray 18 correlates to a card having a specific suit and rank order. The card tray 18 is discussed in more detail with reference to FIGS. 2A and 2B.

Stacked decks of cards existing in their proper suit and rank, all facing in the proper direction, are delivered into and held within the completed deck hopper 24. Defective or rejected cards are directed to the ejected card hopper 22 from two components within the apparatus. These include the imaging means 18 and the CPU 14 when a previously processed card is detected. The computer display screen with operator input 20 provides an enlarged or magnified image of playing cards that have been identified as potentially marked or defective in some manner. The operator of the method and apparatus of the present invention may then view the enlarged image of the marked or defective area of the playing card on the display screen 20 and then direct the apparatus of the present invention to either accept the card and leave it in the tray 18, or reject that playing card, by inputting the proper signal into the central processing unit 14, via the operator input buttons 21.

The display screen 20 may comprise touch screen capabilities in order to allow an operator of the apparatus to simply touch operator input buttons which appear on the display screen 20, in order to input specific instructions or directions. Alternatively, operator input means 21 may be separated from the display screen 20, like a typical keypad but consisting of a minimal number of specialized buttons.

The central processing unit (CPU) 14 functions to compare the images produced from the imaging means with a set or sets of known good reference images that have been previously input into a memory (not separately shown) of the CPU 14. The CPU 14 also functions to send to and receive signals from, the input hopper 12, the imaging means 16, the card tray 18, and the computer display screen having input capabilities 20. Alternatively, of separate operator input means 21 is utilized, the CPU 14 functions to send signals to, not receive signals from, the computer display screen 20, and further functions to receive signals from, not send signals to, the operator input buttons 21.

Figure 2A:
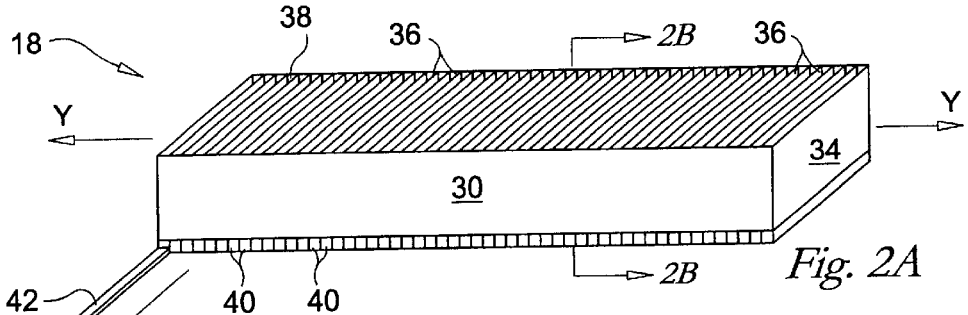
FIG. 2A is a perspective view of one embodiment of a card tray or card receiving member used in accordance with the apparatus of FIG. 1.
Figure 2B:
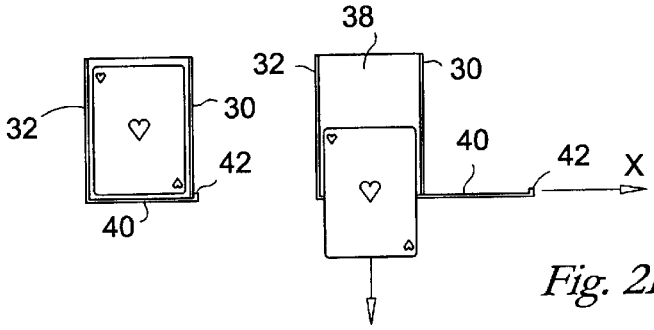
FIG. 2B is a cross-sectional view of the card tray or card receiving member shown in FIG. 2A taken along line 2B—2B of FIG. 2A.

Turning now to FIGS. 2A and 2B, there is shown one embodiment of the card tray 18 of the present invention. The card tray 18 includes a front wall 30, a back wall 32, two side walls 34, a plurality of slots or openings 38 within the card tray 18, and a plurality of retractable bottom members 40 positioned between the divider members 36. Each retractable bottom member 40 includes a lip 42 to aid in slidably retracting the bottom member 40 from its position within the card tray 18. FIG. 2A shows a perspective view of the card tray 18, with all of the retractable bottom members 40 seated in place within the card tray 18 to provide a plurality of slots 38 for retaining a plurality of playing cards (equal in number to a full standard deck of cards). The card tray 18 preferably includes slots 52 or openings 38 such that an entire deck of playing cards may be retained within the card tray 18. If desired, added slots 38 can be provided to accommodate jokers.

A cross-sectional view of the card tray 18 taken along the line 2B—2B of FIG. 2A is shown in FIG. 2B. Playing card 44 is positioned within the slot 38. The retractable bottom member 42, which forms the bottom of the slot 38, is slidably retracted in the direction shown by vector X. As a result, the playing card 44 drops out of the slot 38. The card tray 18 may move in either a horizontal or vertical plane. The plurality of retractable bottom members 40 are designed to move perpendicular to the movement of the card tray 18. Therefore, as can be seen in FIG. 2A, if the card tray 18 moves back and forth along a horizontal plane, as shown by vectors Y, the retractable bottom members 40 move along the same horizontal plane but in a direction perpendicular to the direction of movement of the card tray 18, as shown by vector X.

In the, operation of the apparatus of FIG. 1, one or more decks of playing cards are input into the input hopper 12 of the apparatus of the present invention. Next, individual playing cards are fed into the imaging means 16 of the apparatus of the present invention one at a time. When the imaging means 16 detects the delivery of a playing card, it then determines whether or not a single playing card is present. If more than one playing card is present, the imaging means 16 rejects the cards to the hopper 22, or, alternatively, reroutes the playing cards back to the input hopper; so that they can be again fed to the imaging means 16. The imaging means 16 also feeds a color image of the back of the first card input into the imaging means 16 to the CPU 14 which compares the image to the remainder of the card deck being sequenced and inspected, to insure that the entire deck of playing cards being sequenced and inspected are of the same color.

If a single card is detected as being present, multiple images of the card are taken. These images are fed to the central processing unit 14 of the apparatus of the present invention in order to make comparisons with the information relating to a complete and non-defective set of similar playing cards contained in the memory of the CPU 14. Next, the images of the playing card are compared to the information stored within the CPU 14 to determine whether a duplicate of the card has been previously processed. If a duplicate of the card has already been processed and deposited in the card tray 18, a determination is made whether or not a single deck is being processed. If it is, the card is ejected. Alternatively, if a single deck is not being processed (i.e. multiple-decks are being processed), the card is sent back to the input hopper 12 for reprocessing. If multiple decks of cards are not being processed, the ejected cards can be manually fed back into the imaging means for the next run of cards, upon completion of this run of cards. This determination is made by comparing the images taken of the card with those images contained in the memory of the CPU relating to a perfect set of cards.

If the card is not defective or marked, it is delivered to the card tray 18. If the card is defective or marked, a magnified image of the card is displayed on the computer display screen 20 of the apparatus of the present invention. The operator of the apparatus then is able to either accept or reject the card by inspection, based on the magnified images shown on the display screen 20. If the operator accepts the card, the card is delivered to the card tray 18. If the operator does not accept the card, the card is ejected; and the operator can then manually inspect the card. If the card is accepted by the operator, the operator places the card back into the input hopper 12 from which it is once again automatically fed into the imaging means at 62. If the card is rejected by the operator, the operator places the card aside and does not return the card to the apparatus 10 of the present invention.

Once a card has been delivered to the card tray 18, the CPU 14 determines whether or not there is a complete deck of cards contained, in sequence, within the card tray 18. If it is determined that a complete deck of cards is contained in the card tray 18, i.e. all of the slots 36 in the card tray 18 are filled, with cards in the order of a properly sequence deck of cards, then the complete deck of sequenced cards is delivered to the completed deck hopper 24. On the other hand, if it is determined that the card tray 18 lacks a complete deck of sequenced cards, i.e. all of the slots 36 in card tray 18 are not filled, the CPU 24 sends a signal to the housing 12 to feed another card to the imaging means 16.

Figure 5:
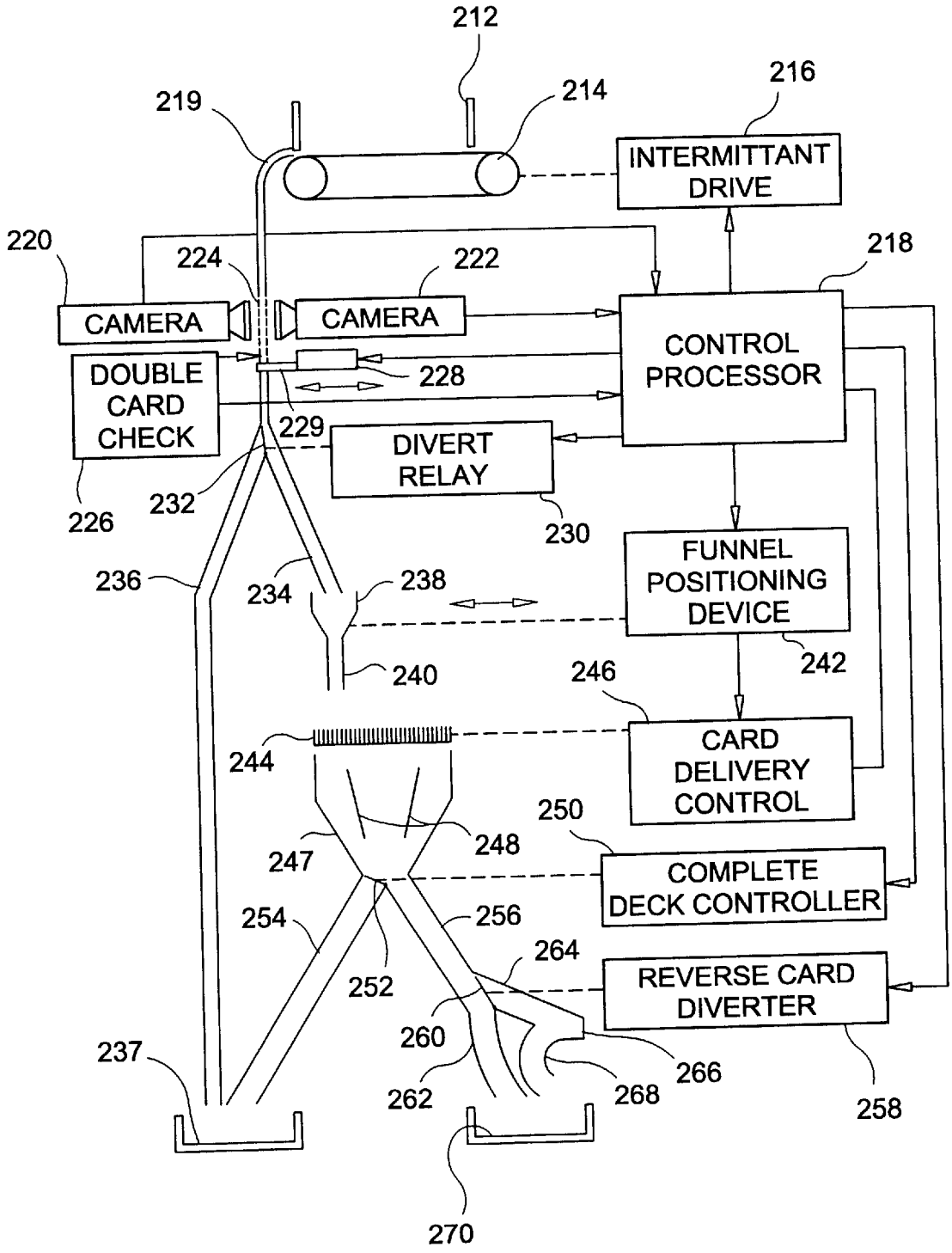
FIG. 5 is a schematic diagram of an alternative embodiment of the invention.

Turning now to FIG. 5, a diagrammatic representation of the inter-relationship between the path for the physical movement of a playing card and the processor communication channel of the automated interactive method and apparatus of the present invention for sequencing and/or inspecting playing cards is shown. First, one or more decks of unsorted cards is placed into the input hopper/card feed device 112, also known as input hopper 12 in FIG. 1, by an operator. A sensor in the input hopper/card feed device 112 notifies the embedded processor 114, also known as the central processing unit 14 in FIG. 1, that a deck of cards is present within the input hopper/card feed device 112. The embedded processor 114 then instructs the input hopper/card feed device 112 to advance one card from the input hopper/card feed device 112 to the digital imaging station/flipper 116.

All card movement relating to the automated method and apparatus of the present invention for sequencing and/or inspecting playing cards may, and should, take place by gravity with the exception of the input hopper/card feed device 112, which is mechanically designed to dispense one card at a time from the device 112. Alternatively, motorized transport may be utilized to move the playing cards in accordance with the method and apparatus of the present invention; but motorized transport should not be necessary. The automated interactive apparatus of the present invention for sequencing and/or inspecting playing cards is designed to minimize the distance of travel for the playing cards between all of its components.

The digital imaging station/flipper 116 preferably is comprised of a substantially vertical plate having a ledge on the bottom thereof and guides positioned along a surface of the plate to center the card. The digital imaging station/flipper 116 is preferably comprised of a non-reflective black material. The vertical plate includes an opening for allowing a light beam to determine the number of cards present on the vertical plate, or as an alternative, a feeler to measure thickness. Mechanical means for flipping the playing card over to expose its opposite side could comprise any number of elements including, but not limited to, rotatable gripping prongs, or any one of a variety of rotating shelf members which pivot about a predetermined pivot point. The playing card is released from the digital imaging station/flipper 116 by retracting the bottom ledge mechanically, allowing the playing card to fall.

Once positioned in the digital imaging station/flipper 116, a simple emitter/detector measurement is used to determine whether one or more playing cards was advanced into the digital imaging station/flipper 116. A thickness measurement, using various commercial detectors, is compared with stored and known values to determined whether one or more cards is present. If more than one card is found to be present, the embedded processor 114 instructs the diverter 126, which may or may not comprise part of digital imaging station/flipper 116, to reject the playing cards and the cards are released from the digital imaging station/flipper 116 to the eject hopper 122. The embedded processor 114 also notifies the operator by reporting this card rejection on a CRT display screen 120, or an audio signal can be used. The embedded processor 114 then signals the input hopper/card feed device 112 to advance the next card from the input hopper/card feed device 112.

If it is determined that only one card is present in the digital imaging station/flipper 116, one or more digital images are taken of the first side of the card using a digital imaging device, such as a digital camera or scanner, which is contained within the digital imaging station/flipper 116. Once the image(s) is(are) taken of the first side of the card, the digital imaging station/flipper 116 flips the card over to its other side and one or more digital images of the second side of the card are taken with the digital imaging device.

At the start of the method of the present invention for sequencing one or more decks of playing cards, an operator or user may program the apparatus of the present invention via operator input buttons 121, which may or may not be incorporated within the CRT display screen 120. A minimum of four operator input selections should be available for operation with the apparatus including, but not limited to, options such as "start/on", "eject card", "accept card", and "finish/off". In addition, other operator input selections, possibly switch settable, may be included, such as brand of deck to be selected and/or sequenced, number of decks being inspected and/or sequenced, whether the decks being loaded into the apparatus should be sequenced only, or sequenced and inspected, and whether the decks are to include jokers.

If the user or operator has previously indicated, via the operator input button 121, that only sequencing of the deck of cards is desired, then only one image is taken of each side of each playing card. Alternatively, if inspection and sequencing of the cards is desired, multiple images are taken of the back of each playing card possibly utilizing different light sources in order to identify defects such as dimples, fingernail imprints, and tears contained on any portion of the playing card.

The digital imaging means 16 or 116 sends the multiple digital images of the playing cards to the embedded processor 114. The embedded processor 114, in turn, first uses part of one of the multiple digital images of the playing cards to determine if the color of the back of the card is correct based upon the color of the back of the first card submitted to the digital imaging means 16 or station/flipper 116. If the color of the back of a card is not correct, the embedded processor 114 sends a signal to the digital imaging station/flipper 116; and a diverter 126, releases the card to the eject hopper 122. Whenever a card is delivered to the eject hopper 112, the operator is notified via the CRT display screen 120 (or by an audio signal, if no CRT is used). The embedded processor 120 then signals the input hopper/card feed 112 to advance the next card to the digital imaging station/flipper 116.

If a playing card has not been rejected based upon improper color of the back of the card, the embedded processor 114 then determines the rank and suit (position) of the card in a properly sequenced deck of cards, using digital image processing to compare the digital images obtained from that specific playing card against the plurality of stored card images which comprise a complete 52-card deck. This step either comprises an application of pattern recognition technology or other image comparison technology.

Once the embedded processor 114 determines the rank and suit of the individual card, the embedded processor 114 then checks the individual card against its memory to determine if this card is one of the cards that has already been processed. If the card is a duplicate of a card that has already been processed, the embedded processor 114 sends a signal to the digital imaging station/flipper 116 and the diverter 126 to release the card and deliver it to the eject hopper 122. As previously indicated, an operator is notified of any card delivered to the eject hopper 122 via the CRT display screen 120 (or audio signal). The embedded processor 114 then signals the input hopper/card feed 112 to advance the next card to the digital imaging station/flipper 116.

If the card is not rejected as being a card which was previously processed by the embedded processor 114, the embedded processor supplies a signal to position the slotted tray 118 and the diverter 126, so as to accept the card from the digital imaging station/flipper 116. The slotted tray 118 may comprise a tray positioning means to position the slotted tray such that the card can be delivered to its predetermined slot (corresponding to its position in a properly sequence deck of cards). Alternatively, a tray positioning unit 128 may be coupled to the slotted tray 118 in order to perform the function of positioning the slotted tray 118. The embedded processor 114 also instructs the digital imaging station/flipper 116, or diverter 126, to position the cards to face the correct way prior to releasing the card and delivering it to the slotted tray 118. The embedded processor 114 maintains a list in its memory of which cards, by their rank and suit, were positioned into the slots contained in the slotted tray 118.

The above process steps are repeated until (1) the input hopper/card feed device 112 is empty or (2) the embedded processor 114 determines, by utilizing its memory containing the list of cards processed, that a complete deck of cards has been placed, in proper order, into slotted tray 118. Next, if the operation of inspecting the playing cards has not been selected, the embedded processor 114 supplies a signal to cause the release of each card in sequence from the tray 118 into the completed deck delivery hopper 124.

Alternatively, if the operation of inspecting the cards was previously input by the operator, via the operator input buttons 121, the embedded processor 114 begins processing the multiple digital images taken of each card to determine if there are any problems or defects with each card that should be brought to the attention of the operator. This processing of the multiple digital images taken of each card may take place either before the card is positioned within the slotted tray 118, or after the card is positioned within the slotted tray 118.

The processing of the multiple digital images of a card uses either pattern recognition or other image comparison technology, which matches the digital images taken of a card against known good images of playing cards which are stored within the embedded processor 114. Refraction analysis may also be employed. Different positioned light sources, different wavelength emitters and/or filters may be used in obtaining the multiple images in order to find markings which may not otherwise be visible on the playing cards. Accordingly, all markings on the cards may be found, including those which may not be visible to the human eye.

Any problem or defect identified by the embedded processor 114 which exceeds a selected level of significance, a sensitivity setting results in the embedded processor 114 sending a signal to the CRT display screen 120 such that a magnified version of both sides of the problem or defective area of the card is displayed on the CRT screen 120. The questionable or problem area(s) found on the card are highlighted along with a message indicating the possible problem(s) or defect(s) found on the card.

The embedded processor 114 then sends a signal to the operator, via the CRT display screen 120, requesting operator input as to whether to eject the card for physical inspection by the operator, or to accept the card as a playing card being in good enough condition. The operator responds to this query by selecting the appropriate operator input button 121.

If the operator instructs a card to be ejected for physical inspection, the embedded processor 114 sends a signal, depending upon where the subject card is located, to release the card and deliver it to the eject hopper 122. As previously discussed, this signaling process will depend upon which embodiment of the method of the present invention is. utilized for sequencing and/or inspecting a deck of playing cards. In one embodiment of the method, the playing cards may be inspected prior to being positioned within the slotted tray 118; and in another embodiment of the method, the playing cards may be inspected after being positioned within the slotted tray 118.

Once the card is delivered to the eject hopper 122, the operator manually inspects the playing card. After physically inspecting the ejected card, the operator may place the playing card back into the input hopper/card feed device 112 where the card will again be processed. When the card is processed a second time, the embedded processor 114 will either recognize the card as being previously processed, and thereby allow the card to be accepted into the slotted tray 118, or again query the operator, who will then indicate the card is to be accepted.

Once a completed deck of cards is obtained and delivered to the completed deck hopper, the embedded processor 114 displays a summary report to the operator on the CRT display screen 120, which includes information as to the number of duplicate cards ejected, the number of cards having the wrong color backs ejected, and if in the inspection mode, an overall wear rating for a specific deck of cards.

If the apparatus of the present invention indicates that all of the cards loaded into the input hopper have been processed, and the slotted tray 118 does not contain a complete deck of cards, the embedded processor 114 sends a signal such that the cards within the tray 118 all are released to the eject hopper 122.

Figure 4:
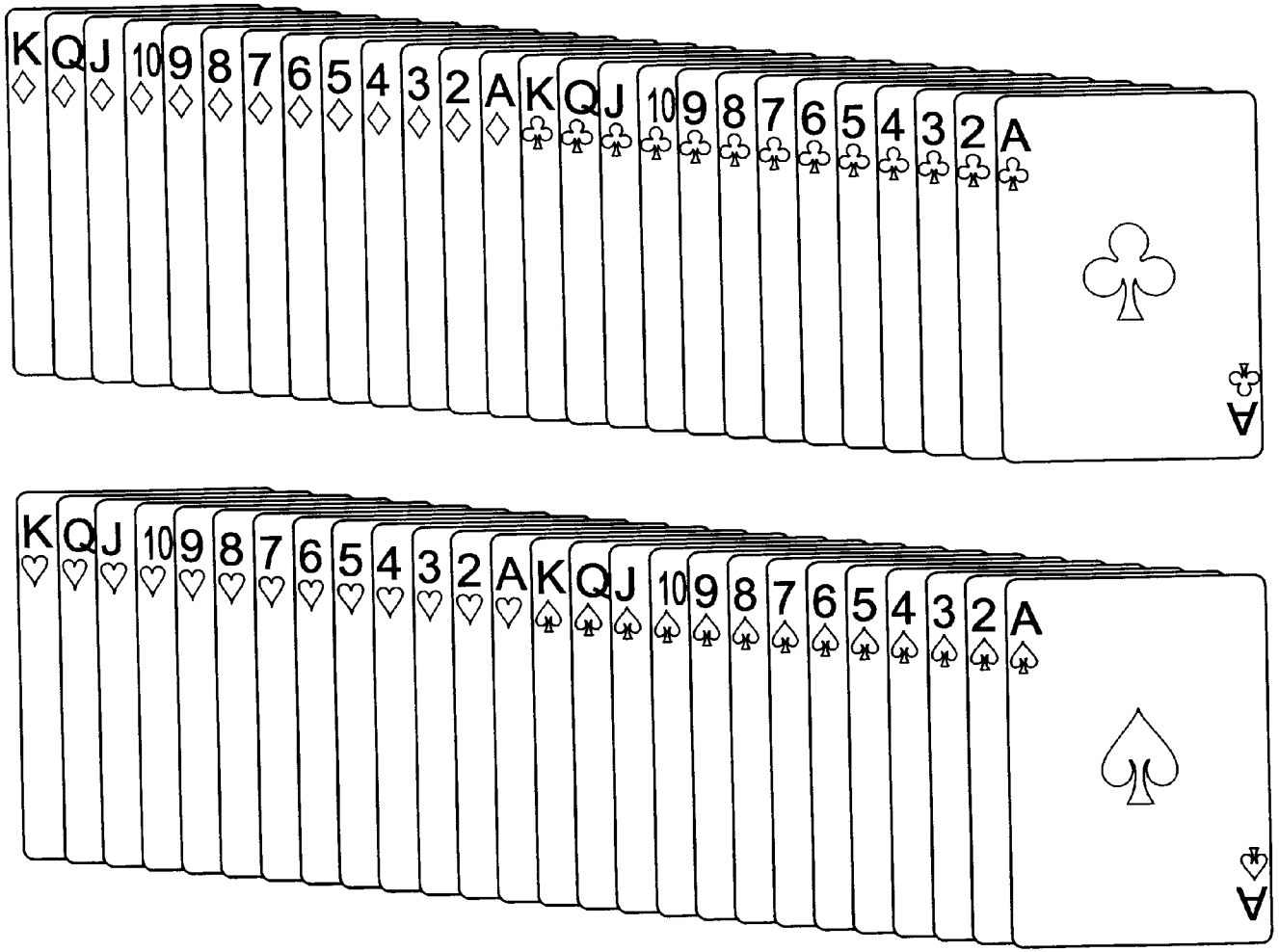
FIG. 4 is an illustration of a properly sequenced deck of cards.

Reference now should be made to FIG. 4 for a better understanding of the actual appearance of a properly sequenced deck of playing cards. In FIG. 4, a full deck of 52 playing cards is illustrated. The sequence is shown broken into two different parts; but it is to be understood that the right-hand card of the top row is placed beneath the left-hand card of the bottom row in a full deck of cards. When a deck is spread by the dealer before being placed in play, the cards may be spread as one row, or more often in two rows, as shown, for a quick visual examination of the sequenced deck of cards. As is readily apparent from an examination of FIG. 4, the sequence begins with diamonds on top. The king of diamonds occupies the top position in the deck, as illustrated by the left-hand king of diamonds in the upper row of the two rows of FIG. 4. Next are clubs, followed by hearts and spades, with the ace of spades located on the bottom. This arrangement, which is shown in detail in FIG. 4, is the arrangement of a deck of cards which is referred to as a sequenced deck of cards, or a properly sequenced deck of cards, throughout the foregoing and ensuing descriptions.

Figure 6:
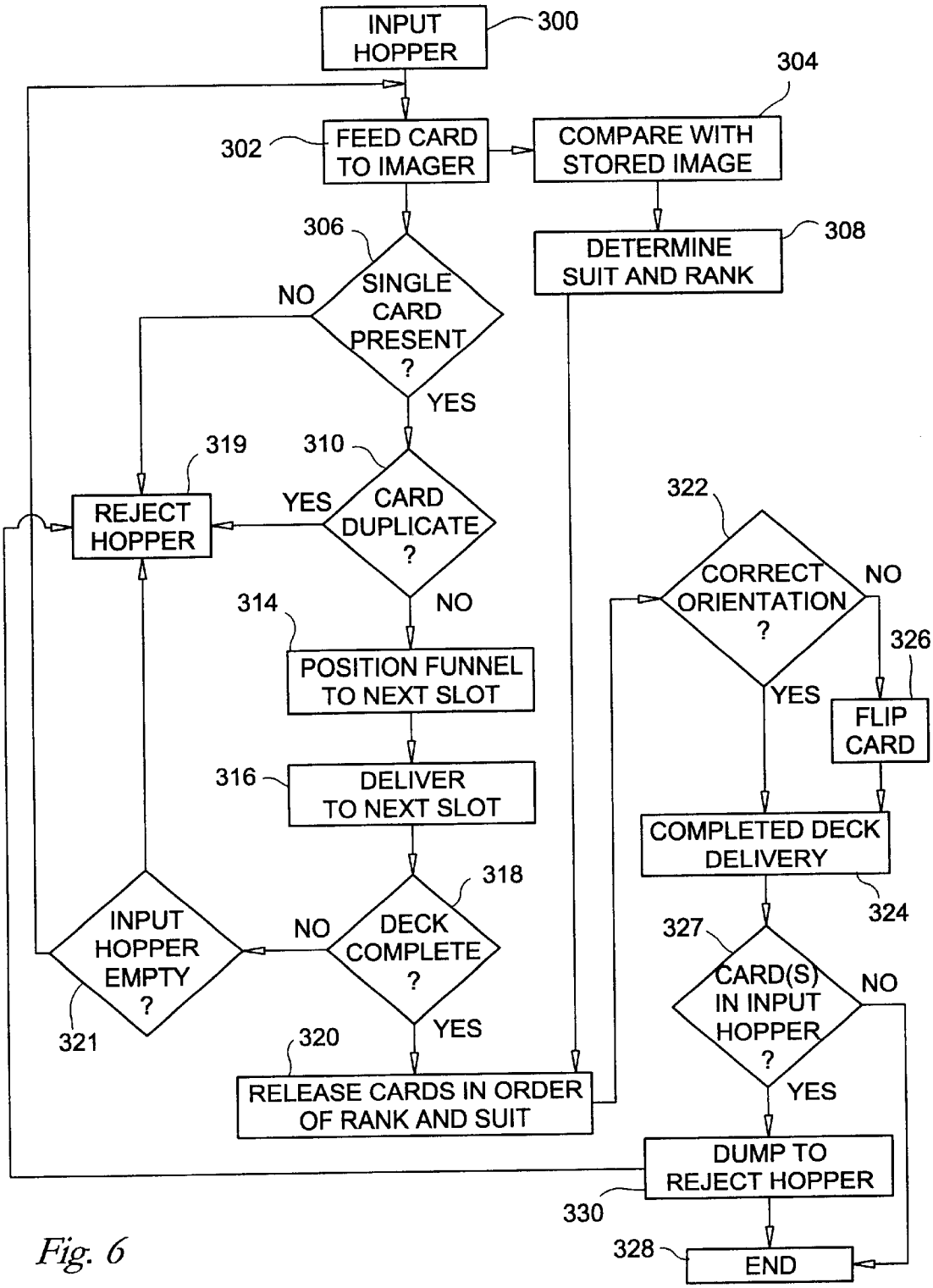
FIG. 6 is a flow chart of the operation of the embodiment of FIG. 5.

Reference now should be made to FIG. 5, which is a detailed diagrammatic illustration of a preferred embodiment of the invention directed to card sequencing only, without any-inspection features added. The embodiment of the invention shown in FIG. 6 is a device in which the cards which are being placed in order (sequenced) move by gravity from one position to another throughout the device, with the exception of the initial withdrawal of the cards from an input card hopper 212. The device of FIG. 5 also is relatively small in size. All of the components shown in FIG. 5 can be located in a housing which is less than two feet high, and which has the general footprint size of a personal computer. Actual structural details of many of the components shown in FIG. 6 are not shown, since those details of structure are conventional and are readily implemented. The various channels shown in FIG. 5 for guiding the cards from the uppermost position in the input card hopper 212 to the final position in the sequenced card hopper 270 typically are made of acrylic plastic, or other suitable materials, and have a cross-sectional configuration which is rectangular, slightly wider than the width of a card, and, in most places, no deeper than the thickness of two or three cards. This permits easy and rapid movement or dropping of a card by gravity through the system, which is described subsequently.

Figure 3:
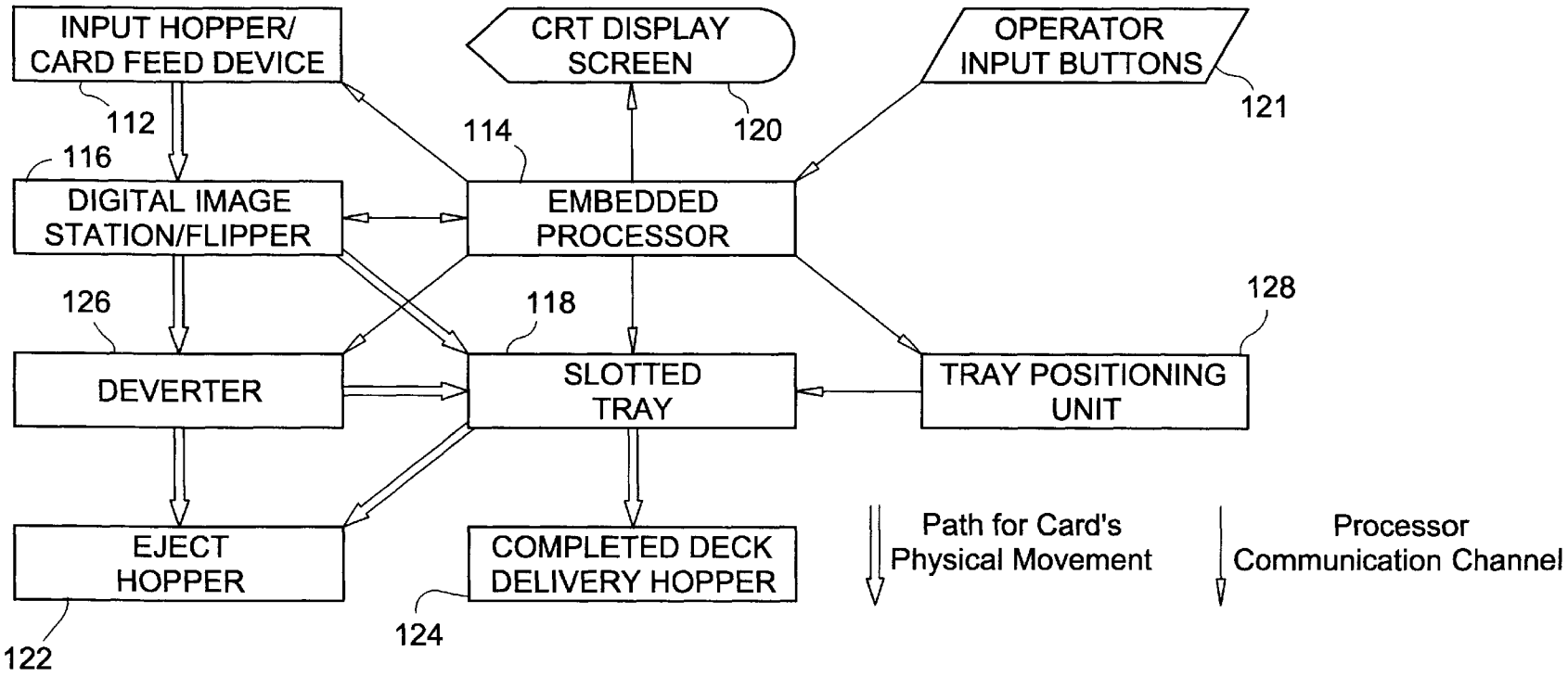
FIG. 3 is a diagrammatic representation of the interrelation between the components of the embodiment of FIG. 1.

It should be noted that the device of FIG. 5 is a basic automatic sequencing device which does not include the inspection features described previously in conjunction with FIGS. 1 through 3. The system of FIG. 5 constitutes the basic embodiment of the invention for reordering (sequencing) a deck of cards, which has been played and shuffled, back into a properly sequenced deck of cards having the location and order of the cards illustrated in FIG. 4.

In the embodiment of FIG. 5, the deck to be sequenced is placed in the rectangular hopper 212, the open bottom of which rests on top of a short conveyor or card feed mechanism 214, which constitutes the bottom of the hopper 212. The distance between the left-hand end of the conveyor 214, as illustrated in FIG. 5, and the bottom edge of the left-hand side of the hopper 212 is adjustable to be slightly greater than the thickness of a card, but less than the thickness of two cards. When an intermittent drive 216, controlled by control processor 218, rotates the conveyor 214 a distance slightly greater than the length of a card, one card is withdrawn from the bottom of the stack of cards in the hopper 212 and it is moved into the open end of a rectangular cross section input chute or channel 219. From this point on, the movement of the cards through the system either to the output hoppers 270 or 237, shown on the bottom of FIG. 5, is by gravity. The gravity drop system is important because such a system places less wear and tear on the cards passing through the system. It is desirable, for cards which are repeatedly used, such as in casinos, to subject the cards to as little wear as possible during the sequencing operation.

Once the intermittent card feed device 214/216 feeds the card into the input chute or channel 219, the card drops until it hits a retractable stop 229 operated by a relay or solenoid 228. The stop 229 normally extends into the side of a vertical channel portion 224, which has transparent glass windows on each side or open cutouts for undistorted viewing. Typically, the entire chute or channel 219, 224 and the other portions described subsequently are made of plastic, with the exception of the windows.

Figure 7:
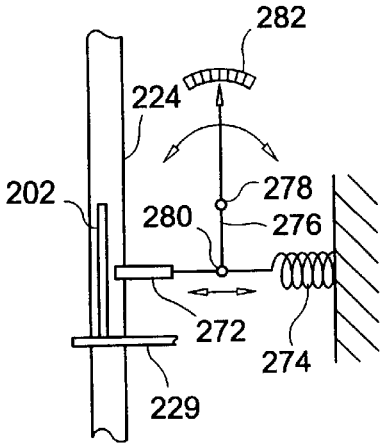
FIG. 7 is a detail of an alternative to a portion of the embodiment shown in FIG. 5.
Figure 8:
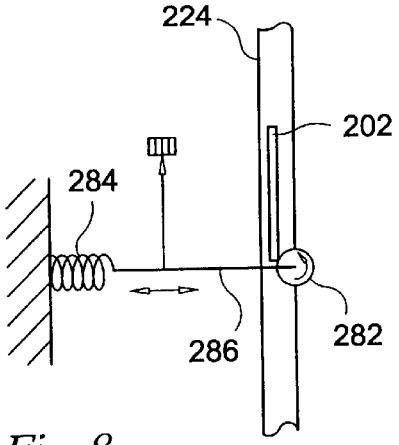
FIG. 8 is a detail of another alternative of a portion of the embodiment shown in FIG. 5.

When the cards stop on the retractable stop 229, two events take place. First, a double card check is made by a device 226 to determine that the card thickness, in the channel at the position 224, is not greater than an anticipated thickness (which previously was set by a measurement of the first card of a deck being processed). FIGS. 7 and 8 illustrate two variations of devices which can be used for the double card thickness detector 226. Typically, a set of probes or an individual spring-loaded probe extends into the channel at the location 224 to press the card (or cards, if double cards are present) against the opposite wall of the channel. The movement of the probe or location of the probe then is utilized to determine whether or not a double card is present. If double cards are detected, a signal is sent from the double card check apparatus 226 to the control processor 218, which then operates a divert relay 230 to move a diverter arm 232 from its normal position (rotated toward the left, as shown in FIG. 5) to a right-hand position. This opens the chute or channels 236 and closes the chute or channel 234 for the subsequent dropping of the card. After the double card check is made, the retractable stop relay 228 is operated to pull the stop 229 to the right to release the cards. They then drop downwardly and are diverted by the diverter arm 232 into the channel 236 to drop into a reject card hopper 237. The cards may be left in the hopper 237, or they may be manually taken from the hopper and placed back into the input hopper 212 by an operator observing the operation of the system. In a much more sophisticated system, designed to have multiple decks, a motorized transport designed to return duplicate cards automatically back to the input hopper would be used. In such a system, the chute 236 would not discharge in the hopper 237; but instead it would lead to a mechanical continuous elevator, the top of which would dump the card into the hopper 212. Whether this is done manually or automatically is not important to the sequencing operation of the invention.

Figure 11:
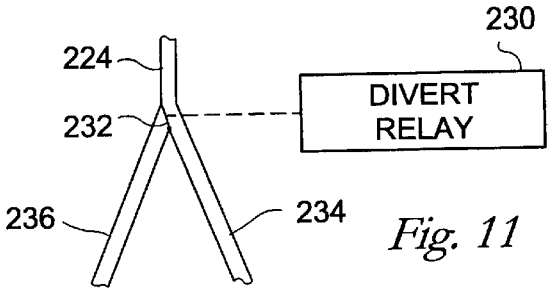
FIG. 11 is a detail of the portion of the embodiment shown in FIG. 5.

Assuming, however, that a single card is present. After the double check is effected by the apparatus 226 and the control processor is provided with a signal indicating that only a single card is present, the divert relay 230 is not operated; and the divert arm 232 (shown most clearly in FIG. 11) is left in the left-hand position as shown in both FIGS. 5 and 11.

Imaging cameras 220 and 222, located on opposite sides of the guide channel 224, are used to obtain one or more images of each side of the card after the double card check is made. A low resolution is made of the front to determine suit and rank and back to determine color of the card. Generally, high resolution imaging is utilized to determine fine marks and problems. If the system is not in an inspect mode, and it is not in the embodiment described in conjunction with FIG. 5, it is possible to use the cameras 220 and 222 simply to image a corner of the card, since the information necessary as to color and suit and rank is available in this portion of each card.

As described previously in conjunction with FIGS. 1 through 3, the image or images taken by the cameras 220 and 224 are supplied to a comparison circuit in the control processor 218, which compares these images with stored images of a corresponding deck of cards to determine which card and what color card is detected by the camera or cameras 220 and 222.

Once the comparison is made, the control processor 218 utilizes the identification of the card to determine its position in a properly sequenced deck of cards. Depending upon the type of system which is employed, this position identification information is utilized by the control processor in one or the other of two different ways. For a system of the type described previously in conjunction with FIGS. 1 through 3, where a slotted tray 40 with assigned slots is employed, either the tray is moved beneath a fixed delivery chute to properly locate the slot associated with the identified card beneath the delivery chute, or a funnel positioning device 242 moves a guide funnel 238 over the corresponding slot for that card in a tray 244 having fifty-two slots (or more, if jokers or other cards are to be part of the sequenced deck).

Preferably, the system shown in FIG. 5 operates with a fixed position tray 244; and the funnel 238 is moved, one slot at a time, by the funnel positioning device 242 after the control processor 218 has identified the card to determine its subsequent position in a properly sequenced deck of cards. Each card is delivered to the next available slot in the tray 244, one slot at a time. This results in cards placed in the tray 244 in a random order (except that the control processor 218 stores the information as to the location for subsequent delivery from the tray in a properly sequenced order).

The output end 240 of the funnel 238 is located over the desired slot in the tray 244, for whichever of the above systems is used. Once the positioning of the funnel 238 is complete, the control processor 218 sends a signal to the retractable stop relay 228 to withdraw the stop 229 toward the right to allow the card to drop. The diverter 232 is set to the position shown in FIGS. 5 and 11; and the card drops through the chute or channel 234 and through the funnel 238 and its output end 240 to fall into the selected slot in the slotted tray 244. The foregoing sequence of operation is effected for all of the cards in the input hopper 212.

For the system where the tray 40 or 244 has assigned slots, if a duplicate card to one which already has been moved through the system and is in the slotted tray 244 is identified by the cameras 220 and 222, the control processor 218 operates the divert relay 230 to move the pivoted arm 232 to the right. The card, which is identified as a duplicate, then drops through the channel 236 and is deposited in the reject hopper 237 when the stop 229 is withdrawn.

For the system operation which places the cards in the tray 244 in a random sequence by a step-by-step positioning of the funnel 238 to each of the slots, from one to the next, duplicates are allowed in the tray 244. The identification of duplicate cards may not take place until after cards are placed in the tray 244. Either way, duplicate cards are identified; and the information is stored in the memory of the control processor 218 for subsequent use by a card delivery control apparatus 246, the operation of which is described in greater detail subsequently. For a random order temporary storage of the cards in the tray 244, it is possible that duplicate cards may be stored in different slots of the tray 244, which functions as a temporary storage. When a random order tray 244 is used, additional slots, greater in number than the slots of a properly sequenced deck of cards, typically are provided. The determination of rejection of a duplicate card then is made in conjunction with the operation of a complete deck controller 250 to operate an arm 252 when the second or duplicate card is delivered by the card delivery control mechanism 246 to pull the diverter arm 252 toward the right, as shown in FIG. 6, and dump the duplicate card through a chute 254 into the reject hopper 237. With the system operated in either of the two different modes of operation described above, however, ejection or rejection of duplicate cards is effected, either at the position 232 or at the position 252 to dump those cards into the reject hopper 237. The time at which this is done, however, is different, as described above.

Once the control processor 218 has received comparison signals from all of the cards in a deck of cards, the funnel positioning device 242 will have positioned the funnel 238 and its output end 240 over each of the slots in the slotted tray 244 to locate a full deck of cards (either in random sequence or in proper sequence) in the tray 244. This entire operation has been accomplished by means of gravity, with the exception of the initial feeding of the card from the bottom of the hopper 212 by means of the belt feeder 214, as described previously. It should be noted that if the input hopper 212 is empty before an entire deck of cards is placed in the tray 244, a sensing signal (not shown) to the control processor can indicate that the hopper is empty; and the operation described above can be terminated, since no further cards are available to make a complete sequenced deck. The entire number of cards in the tray 244 is released in random order after the arm 252 is pulled to the right, as viewed in FIG. 6.

An additional step can be effected prior to the release of the card by withdrawal of the retractable stop 229. A press plate may be positioned a certain distance from the card (greater than the thickness of a card, but very close to that thickness). If the card then drops when the retractable stop 229 is pulled away, the processing of the card takes place as described above. If, however, the card does not move, it is too bent to process, since the press plate is holding it on one side and the opposite wall of the channel 224 is holding it on the other. An electric eye (not shown) may be used to verify that the card drops. When this occurs, the divert relay 230 (either electric or pneumatic) is operated to pull the arm 232 to the right. Then the press plate (not shown) is returned to its home or rest position and the card is dropped into the reject hopper 237. Such a device is not shown in FIG. 6, but it would be included to prevent bent cards from jamming the system during later processing.

The reason for including a bent card detector in the position described above is that typically when a bad card (one with a spot or other problem) is found by the dealer during play in a casino, the dealer will sometimes bend the bad card completely in half and then straighten it out and put it back into the deck that is being traded in for a new one. The logic of this is that whenever the decks of cards are subsequently resequenced by a casino employee, the marked card, being also bent, will be readily noticed and not inadvertently be put back in play. For the automatic device which is described and shown in the various figures of the drawings, it is necessary to provide for an automatic detection of bent or severely bent cards; or such cards could possibly jam in the card trays 40 or 244, or in various ones of the chutes through which the cards pass during operation of the system.

It should be noted that, starting with the first image of the first card, the color or image of the back of the card is supplied to the control processor 218, as well as the suit and rank of the card. If a subsequent card then has the wrong (different) color on its back, it is treated as a duplicate card; and the divert relay 230 is operated, as described previously for duplicate cards, to cause the card to be dropped through the channel 236 into the reject hopper 237 when the retractable arm 229 is drawn to the right by the relay 228.

In the event that, for some reason, a completed deck is not placed in the slotted tray 244, a complete deck controller 250 is operated by the control processor 218 to operate another diversion arm 252 from its normal position, toward the left as shown in FIG. 6, toward its right-hand position. The arm 252 is similar to the arm 232 illustrated in enlarged detail in FIG. 12, and operates in the same manner as the divert relay arm 232 described previously. Thus, if a complete deck is not present, the arm 252 is moved to the right, and the card delivery control device 246 is used to empty the slotted tray 244, in a manner similar to that described above in conjunction with FIGS. 1 through 3, to drop all of the cards out of the tray 244 in random order, where they are diverted into the reject hopper 237, through the channel 254.

Assume, however, as is normally the case, a completed deck is present in the slotted tray 244. Once the central processor 218 has processed all cards of a deck, and the determination is made that they have been placed in the tray 244, the card delivery control 246 is operated by the control processor to remove the cards, one at a time, in proper sequence, from the tray 244. This is done by means of opening individual movable bottoms in each of the slots, in the order determined by the random position stored by the control processor 218 at the time of delivery of cards to the tray 244. For sequenced storage, the bottom of the slotted tray 244 may be a single rectangular member, which is movable from left to right underneath the slots in the tray 244. The most left-hand slot of the tray 244 first is opened, then the next one to the right, and so on until all 52 slots have been sequentially opened, one at a time. For either operating-mode of the system, the cards in the tray 244 drop, one at a time in proper sequence, through a card delivery chute 247. The chute 247 preferably also includes some guide plates 248 through it, parallel to the depth or width of the slots in the tray 244 to allow the cards to drop without tumbling as the cards fall through the chute 247 toward the diverter 252.

For a properly sequenced deck, the diverter 252 is in the position shown in FIG. 5; and the cards move one at a time through the chute or channel 256 to another diverter 260. The diverter 260 is normally positioned toward the right, as shown in FIG. 5, and it is operated by a reverse card diverter relay 258. Synchronization between the reverse card diverter relay 258 and the card delivery control 246 is effected by the control processor 218. Thus, for any card which is placed in the tray 244, facing in a direction other than one intended for straight through placement in the completed card hopper 270, the reverse card diverter 258 is operated to cause the arm 260 to be moved to the left, as shown in FIG. 5. Any card then falling from the bottom of the chute 247 and passing through the channel 256 then is guided into the channel 264, where it hits an end 266. The card is stopped and then falls over a curved projection 266 to reverse its sides. The card then drops in its proper orientation into the tray 270.

For cards which are oriented in accordance with the manner they are to be placed in the tray 270, the diverter 260 is located in the position shown in solid lines in FIG. 5; and the cards move from the bottom of the chute 247 through the channel 256 and past the diverter 260 into the channel 262, from which they are delivered into the completed deck tray 270.

After the cards have all been removed from the tray 244 by opening the bottoms of all of the slots, in either of the manners described above, a final step is to check the slots of the tray 244 by means of a light beam or otherwise, through the tray from end to end, to determine whether any cards are somehow hung up in the tray 244 and did not fall when the bottom of the slot in which those cards were placed was opened. If cards are hung up, a signal then is supplied to the control processor 218 (by means not shown) to indicate to the operator that the deck of cards in the hopper 270 is not complete; and a manual visual check then may be made by the operator. It is intended that the front of the device be a hinged door which forms the fourth side of all of the areas where the cards move, thereby allowing easy location and removal of any jammed card.

Reference now should be made to FIG. 6, which shows the operating sequence of the events which have been described previously in conjunction with the apparatus for the gravity fed card sequencing device shown in FIG. 5. As shown in FIG. 6, cards are placed in an input hopper 300, from which they then are fed in the next step to an imager at 302. In the imager, two things are done. First, the image of the card in the imager is compared with a stored image at 304 to determine the suit and rank for the sequence position at 308. The suit and rank sequence position at 308 then is used later to control sequential delivery of the cards. A determination then is made at 306 as to whether or not a single card is present. If it is not, the two cards are dropped into a reject hopper 319. If a single card is present at 306, however, it then is checked at 310 to determine whether the card is a duplicate of one already processed. If it is a duplicate, it is ejected into the reject hopper 319. If the card is not a duplicate, it is delivered to the funnel position at 314 to supply the card to the next slot in the temporary storage tray at 316. This operation is repeated for each card fed from the input hopper 300 through the system. At each delivery, a determination is made at 318 as to whether the deck is complete. If it is not, a check at 321 determines if the hopper 300 is empty. If the hopper 300 is not empty, the next card is fed to the imager 302. If the hopper is empty, all of the cards are randomly released to the reject hopper 319.

If, as desired, the deck is complete at 318, the deck then is sequentially released at 320 under control of the suit and rank information at 308. A determination is made at 322 as to whether the card is of correct orientation. If the card does not have the correct orientation, it is flipped at 326 in the manner described previously in conjunction with the apparatus 264/266/268. After the card is flipped, it supplied to the completed deck delivery at 324. If the card does have correct orientation as it is sequentially released at 320, that determination is made at 322 and it is delivered directly to the completed deck delivery at 324. Once this operation has been effected for an entire deck of cards, the cards which are placed at the completed deck delivery position 324 are a properly sequenced deck of cards, irrespective of the order of the cards which originally were present in the input hopper 300. Once again, a check is made at 326 to see if the input hopper is empty. If it is, the process ends at 328. If cards remain in the hopper 300, they are dumped at 330 to the reject hopper 319; and the process ends at 328.

Reference now should be made to FIG. 7, which illustrates in greater detail one possible form of the double card check 226, which was described above in conjunction with FIG. 6. As shown in FIG. 7, the card 202 in position in the region 224 of the card guide channel is resting on the retractable stop 229. A compression spring 274 is attached through a rod to a sensing finger 276, which extends through an opening in the side wall of the channel 224 to be engaged by the card 202. The sensing finger 272 may be moved into place once a card drops onto the retractable arm 224; or it may continually be in place under a very light load to press against the side of the card 202. Ideally, the finger 272 is moved into place only to test the card thickness, and then is moved back out of the channel 224 when the thickness test is completed.

As illustrated in FIG. 7, a mechanical gauge is used to indicate the thickness; but it is readily apparent that the distance measurement may be effected by means of a Piezoelectric stress gauge, a photoelectric sensor, or the like, to provide a signal to the control processor 218 in the manner described previously in conjunction with FIG. 5. The diagrammatic representation of FIG. 7, however, shows that the sensor arm 272 moves back and forth against the action of the spring 274. A needle or indicator arm is pivoted about the pivot 276, and rotated about a hinge 280 to move an indicator on a curved scale 282. The scale 282 may be provided with indicia showing the relative thickness of the card 202. This information also may be supplied electronically to the control processor 218 to operate in the manner described previously in conjunction with the operation of the system shown in FIG. 5.

Figure 9:
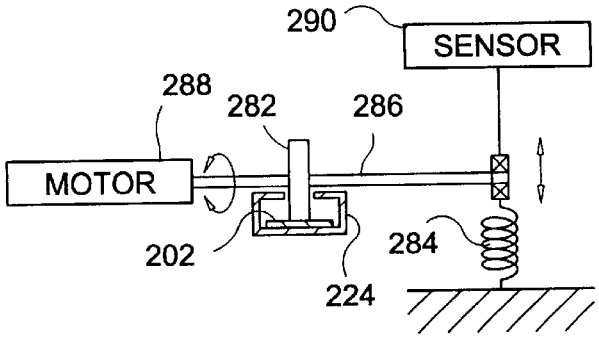
FIG. 9 is a cross section taken along the line 10—10 of FIG. 8.

FIGS. 8 and 9 show an alternative embodiment of the double card check 226. In the device shown in FIGS. 8 and 9, a wheel 282 extends into the side of the channel 224 (shown most clearly in FIG. 10) to control the speed of movement of the card through the channel 224. The wheel 282 is spring loaded by means of a spring 284 to draw it toward the opposite side of the channel 224 from the one through which it enters. A motor 228 is used to drive the wheel 222; and a sensor is connected to the opposite end of a shaft in the wheel 282 (extending through a bearing) to note the pivotal movement (back and forth from left to right, as shown in FIG. 8 or up and down, as shown in FIG. 9) to operate a sensor which may be an indicator, such as the indicator 282 of FIG. 7, or a Piezoelectric or photoelectric sensor 290. The signal from the sensor 290 then is supplied to the central processor 218 to indicate whether one or more cards 202 are present in the channel at the time the double card check is made.

Figure 10:
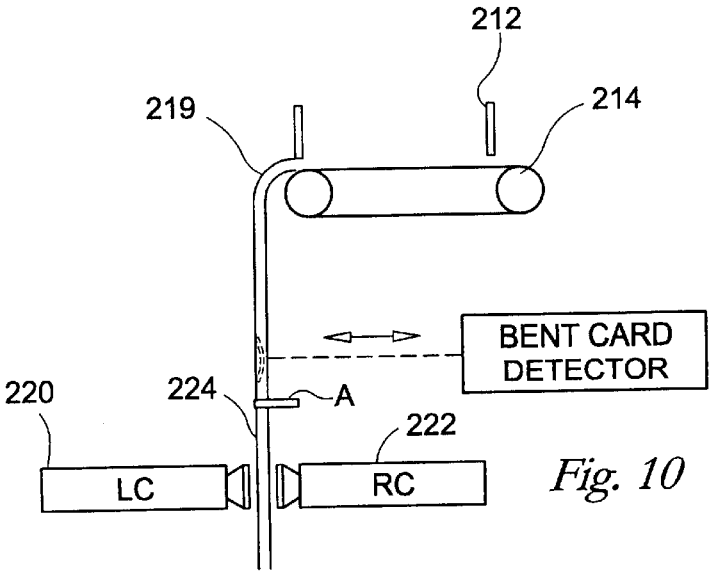
FIG. 10 is a representation of another modification of the embodiment shown in FIG. 5.

FIG. 10 illustrates a variation of the embodiment shown in FIG. 5 at the input channel 219 when the cards first are fed from the input hopper 212 by the intermittently operated belt 214 to supply them to the gravity fed card sequencing mechanism described in FIG. 5. The input chute 219 of the system is designed to be wide enough to allow even severely bent cards to pass through to the bent card detector. Each card is stopped by a stop "A" which is similar to the stop 229 described in conjunction with FIG. 5. At this position, a bent card detector 294 extends a press plate 292 toward the left, as viewed in FIG. 10, to a position spaced from the left-hand side of the lower part of the wall 219, as shown in FIG. 10, which is just slightly wider than the thickness of a non-bent card 202. If the card at this position is bent, subsequent retraction of the stop "A" toward the right (as viewed in FIG. 10) results in the bent card being pressed between the left-hand side of the wall and the plate 292, and held in place against dropping. An electric eye (not shown) determines if the card drops and sends a signal to the processor 218. If a card does not drop, the divert relay 230 operates to pull the divert lever 232 toward the right, as described previously for duplicate card rejection. Subsequent passage of the bent card after the plate 292 is withdrawn to the rightmost position shown in FIG. 10, while the stop "A" continues to be withdrawn to the right, causes the bent card to be diverted by the arm 232 into the reject hopper 237. In summary, if a card is not bent it will fall through to the imaging position at the cameras 226 and 228, as described previously. If it is bent, it will not fall when the arm "A" immediately is withdrawn toward the right, causing the sequence of operation described above to take place.

It should be noted in conjunction with the foregoing description, that the card delivery belt or mechanism 214 may be adjusted vertically with respect to the bottom of the card input hopper 212 to accommodate decks of cards where the cards have differing thicknesses. Once this adjustment is made, however, all of the decks which are supplied to the input hopper 212 should be of the same thickness. When a different type of deck, or a deck from a different manufacturer is provided, a readjustment of the height, particularly of the left-hand end as shown in FIG. 5, of the conveyor drive belt 214 needs to be made in order to ensure that only one card is fed from the bottom of the input hopper 212 into the input channel 219 for each operation of the conveyor belt 214.

The apparatus of the present invention is contemplated as being shipped with a built in default sensitivity level wherein a cutoff point below which a defect or problem found in the card will not be flagged as a defect or problem, but will instead be figured into the wear rating of a particular deck of cards. This sensitivity level may be adjustable by the operator; so that the operator may select a lower or higher sensitivity level with respect to what constitutes a problem or defect with the card. The operator also can turn off the inspection mode.

In addition, in that most casinos use only one of three different brands of cards, the apparatus of the present invention may be pre-loaded with software relating to a particular brand of cards, or all three brands of cards. If the apparatus of the present invention is shipped with software directed to all three brands of standard decks of cards, a selector switch would be included in order to select the brand of card to be inspected and/or sequenced. There would also be a "learn" mode for custom printed cards, such as cards with the name of the casino printed on the back of the cards.

Further, the apparatus of the present invention may also include a hole punching station for individual cards and/or entire decks of cards. Accordingly, if a card or deck of cards is determined to be defective and/or unduly worn, the card or entire deck may have a hole punched through them, thereby establishing them as unacceptable for play within the casino. Punched decks of cards, however, may be sold by the casino or given away as still suitable for home use.

Various modifications will occur to those skilled in the art for performing substantially the same function, in substantially the same way, to achieve substantially the same result without departing from the true scope of the invention as defined in the appended claims.

What is claimed is:

1. Apparatus for sequencing a deck of playing cards including in combination:

a hopper for holding a deck of playing cards and designed to permit removal of playing cards therefrom, one at a time;

a device for removing playing cards from the hopper one at a time;

an imaging device for imaging at least one side of a playing card and providing an output signal corresponding to the image of the playing card;

a channel for guiding a playing card removed from the hopper to the imaging device;

a temporary storage device for storing cards supplied thereto;

a control processor responsive to an output signal from the imaging device for determining the position of each card in a properly sequenced deck of cards;

apparatus for depositing cards passing from the imaging device into the temporary storage device;

mechanism operated by the control processor for removing cards from the temporary storage device, one at a time, in the order of a properly sequenced deck of cards;

apparatus for delivering cards removed from the temporary storage device to a predetermined location; and a device for ejecting all of the cards stored in the temporary storage device following removal of all of the cards from the hopper whenever the cards deposited in the temporary storage device do not make a complete deck of playing cards.

2. The sequencing apparatus of claim 1 wherein guide channels are provided between the hopper, the imaging device, the temporary storage device, the removal mechanism and the predetermined location to permit gravity movement of cards throughout the apparatus.

3. The card sequencing apparatus according to claim 2 wherein the temporary storage device comprises a tray member having a plurality of storage compartments therein at least equal in number to the number of cards in a deck of playing cards and further wherein the mechanism for removing cards from the temporary storage device removes cards from the compartments of the tray member one compartment at a time.

4. The apparatus according to claim 3 further including a reverse card flipping mechanism located between the imaging device and the predetermined location for flipping a card from one face to the other in response to identification of reverse face of a card from the imaging device.

5. The sequencing apparatus according to claim 4 further including a device for ejecting cards whenever predetermined conditions are detected by the imaging device.

6. The sequencing apparatus according to claim 5 further including a device for ejecting all of the cards stored in the temporary storage device following removal of all of the cards from the hopper whenever the number of cards deposited in the temporary storage device is less than the number corresponding to a complete deck of playing cards.

7. The apparatus according to claim 1 further including a reverse card flipping mechanism located between the imaging device and the predetermined location for flipping a card from one face to the other in response to identification of reverse face of a card from the imaging device.

8. The sequencing apparatus according to claim 1 further including a device for ejecting cards whenever predetermined conditions are detected by the imaging device.

* * * * *